United States Patent [19]

Rüter

[11] Patent Number: 4,498,632

[45] Date of Patent: Feb. 12, 1985

[54] PROCESS FOR GRIND-DRYING WET SOLID FUEL

[75] Inventor: Bernhard Rüter, Königsdorf, Fed. Rep. of Germany

[73] Assignee: Rheinische Braunkohlenwerke AG, Cologne, Fed. Rep. of Germany

[21] Appl. No.: 418,623

[22] Filed: Sep. 16, 1982

[51] Int. Cl.[3] ..... B02C 19/12

[52] U.S. Cl. ..... 241/18; 241/24; 241/62; 241/81

[58] Field of Search ..... 241/23, 27, 24, 81, 241/60, 61, 62, 18, 19, 17, 80

[56] References Cited

U.S. PATENT DOCUMENTS

| | | | |
|---|---|---|---|
| 1,576,335 | 3/1926 | Kreisinger | 241/18 X |
| 3,606,173 | 9/1971 | Rowland, Jr. | 241/81 X |
| 4,389,019 | 6/1983 | Adrian et al. | 241/24 X |

*Primary Examiner*—Mark Rosenbaum
*Attorney, Agent, or Firm*—Steele, Gould & Fried

[57] ABSTRACT

In a process and apparatus for grinding and drying a solid fuel such as brown coal or lignite to form dust, in a fan type mill, in the presence of a hot drying gas with a low oxygen content, fine components of the fuel in dust form are separated out before the grinding step and dried. The remaining coarser portion of the fuel is introduced into the drying gas before the grinding step, in dependence on the grain size and moisture content of the fuel. The fuel is sifted or sieved before it is introduced into the mill and after the grinding operation, with the components which are not sufficiently fine then being recycled to the grinding operation, the recycled components being introduced into the circuit after the fresh fuel has been introduced.

7 Claims, 2 Drawing Figures

PROCESS FOR GRIND-DRYING WET SOLID FUEL

BACKGROUND OF THE INVENTION

The invention relates generally to a process and apparatus for the combined grinding and drying (referred to herein as grind-drying) of wet or moist solid fuels to form dust, or finely grained particles, in a fan type mill. Fuels to be processed by the process and apparatus include brown coal or lignite, which may be in coarsely crushed form.

In this specification, the terms brown coal and lignite may be used interchangeably. In other words, a reference to brown coal is intended to include lignite and a reference to lignite is intended to include brown coal. Although brown coal and lignite are often generally considered as the same recent knowledge indicates there may be a difference between the two types of coal. Notwithstanding any such difference, both are encompassed by the present invention. For convenience and brevity, the term brown coal is generally used herein to denote both kinds of material.

One method for the economic production of large amounts of fuel as finely grained particles, or dust form, as is required for example for refining or upgrading brown coal (or lignite) in gasification and liquefaction installations or in firing equipment, is grind-drying as is predominantly used in modern furnaces for steam generators which are fired with brown coal in power generating stations. Such a method involves using a mill which is often referred to as a fan type mill (beater wheel mill) comprising for example a fan and beater arms secured to the fan. The mill thus sucks in a hot drying gas, which more particularly may have a low oxygen content, as is required for drying the crude or as-mined brown coal, together with the brown coal, crushes the coal by means of the beater arms secured to the fan blades, and then discharges the entire gas flow, together with the brown coal dust produced, from the mill.

When using the above-outlined grind-drying process in mills for power generating stations, flue gas or boiler gas is drawn at a temperature of about 1000° C. from the firing chamber and conducted to the mill in a drying section which is generally in the form of a gravity feed shaft. At a suitable distance upstream of the mill, the crude coal which is to be processed is introduced into the gravity feed shaft, so that it is then sucked in by the fan mill, together with the flue gas; the coal now begins to undergo drying in the flow of gas in the shaft. Depending on the amount of coal introduced into the gas flow and the moisture content thereof, hot air, cold air or other cold gas is mixed with the flue gas; the respective proportion of hot air, cold air or cold gas in the drying gas depending on the temperatures in a sifter or separator downstream of the mill. At the point at which the coal is introduced into the gravity feed shaft, with the coal usually being supplied to the gravity feed shaft upstream of the mill in a grain size range of from 0 to 80 mm, the flue gas temperatures are between 600° C. and 800° C. The effect of the hot drying gas on the coal which is added thereto is to cause spontaneous vaporization of a part of the surface water on the coal, in which case the temperature of the gas in the gravity feed shaft abruptly drops. The larger pieces of coal are partly broken up due to the vaporization phenomenon. However, it will be appreciated that the actual step of grinding or crushing the coal is then carried out in the mill. The dust-charged mixture of coal, flue gas, air and vapor (steam) which issues from the mill is first sifted or separated once again, in order to separate out any excessively large pieces of coal, and then injected in the usual manner through burners into the boiler of the steam generator. With the above-described mode of operation, it does not matter whether volatile constituents are expelled from the coal at the stage of the drying process, as the entire mixture is in any case fed directly to the boiler (except of course for the above-mentioned large lumps of coal which are separated out).

The operation of adding hot air, cold air or cold gas to the flue or boiler gas for the purposes of adjusting the drying gas to given, predetermined values is known as conditioning. However, when the grinding installation is partly supplied with crude coal or when the coal has a low water content, it may also be necessary for water additionally to be introduced into the mill. The additional water is usually added by way of nozzles. The addition of water simulates a higher moisture content in the coal. However, a higher moisture content in the coal requires a larger amount of drying gas; the vapors which are produced in larger quantities as a result of the addition of water promote inerting of the process conditions, to which further reference will be made hereinafter.

The grind-drying installations for carrying out the above-indicated steps are simple in design and reliable in operation, and are accordingly economical. However, while they produce a high proportion of fine discharge product, it is still mixed with comparatively coarse material so that the ground material has to be subsequently sifted or graded, if the aim of the process is to be exclusively on production of dust or finely grained particles. A further requirement in regard to the production of brown coal (or lignite) dust is concerned with rendering inert the conditions under which grinding is effected, as brown coal dust is known to ignite easily. In this connection, it is generally necessary for the $O_2$-content of the drying gas to be lower than 8%.

The effect to which reference has already been made above, of driving out of the coal volatile constituents, which are often referred to as the valuable or useful substances, necessarily results in the caloric value of the remaining coal being reduced, which is a disadvantage at any rate when the coal is not subsequently burnt in conjunction with the volatile constituents which have been previously expelled therefrom. In addition, there is always a possibility of the expelled volatile constituents resulting in inadmissible emissions or giving rise to the danger of an explosion.

When drying brown coal, volatile constituents are driven out at relatively low temperatures. Thus, for example, $CO_2$ is driven out when the temperature reaches about 150° C. to 180° C., while methane ($CH_4$) is driven out of the coal from about 250° C. From a temperature of about 300° C. to 350° C., the oxygen present in the brown coal is liberated and passes into the atmosphere in the grinding chamber, and that is a disadvantage from the point of view of carrying out the process under inert conditions, as is required. That same point also arises, although possibly to a lower degree, in regard to fuels other than brown coal.

SUMMARY OF THE INVENTION

An object of the present invention is to provide a process for grind-drying solid fuel in such a way as at least substantially to reduce the amount of volatile constituents which are driven out of the fuel.

Another object of the present invention is to provide a process for grind-drying solid wet fuel to dust or finely grained particles, wherein the fuel is added to a drying gas flow in a controlled manner to attain optimum drying.

Yet another object of the present invention is to provide a process for grind-drying wet solid fuel wherein the grain size and residence time of the fuel introduced into the hot atmosphere of a drying gas are interrelated with the temperature thereof in such a way as substantially to reduce the proportion of volatile constituents which are driven out of the fuel in the drying operation.

Still another object of the present invention is to provide a process for grinding and drying brown coal or lignite to dust in a fan type mill, wherein the residence time of the coal introduced into a flow of drying gas is controlled by the location at which the coal is so introduced, in dependence on the coal grain size.

Still a further object of the present invention is to provide apparatus for carrying out such a process.

These and other objects are achieved by a process for grinding and drying wet solid fuel such as for example coarsely crushed brown coal to dust, in a fan type mill, in the presence of a hot drying gas which in particular may have a low oxygen content, for example down to 8% in the region of the mill, the fuel being introduced into the drying gas before the mixture is fed to the fan mill. Fine components of the fuel, which are substantially in dust form, are separated off before the fuel is introduced into the drying gas. The remaining portion of fuel is introduced into the drying gas in dependence on the grain size thereof, in such a way that the residence time in the drying gas decreases with decreasing grain size.

The present invention also provides an apparatus for grinding and drying wet solid fuel such as coarsely crushed brown coal, to dust, comprising a fan type mill and a hot gas generator which are interconnected by a drying section. A bunker or other suitable storage means supplies the fuel to be processed in the installation, which also has first and second separating or sifting means for sifting the fuel. A dust separator or trap is disposed downstream of the fan type mill. The dust separator or trap communicates with a filter, and a cold gas conduit having at least one branch or portion connected to the gas discharge of the filter. One of the first and second separating means or sifters is arranged upstream of the mill, and the other is arranged downstream thereof, in such a way that the coarse material produced by each of the sifters is introduced into the drying section between the hot gas generator and the mill, upstream of the mill. The cold gas conduit has at least one branch conduit portion which communicates with the drying section, and a second branch conduit portion which communicates with the sifter disposed upstream of the mill. The coarse material issuing from the sifter disposed upstream of the mill is introduced into the drying section upstream of the point at which the material issuing from the sifter downstream of the mill is introduced into the drying section.

The branch of the cold gas conduit which communicates with the drying section connects thereto at an upper end portion thereof, directly downstream of the hot gas generator, while the branch of the cold gas conduit which communicates with the upstream one of the first and second sifters is passed through the discharge from the bunker before entering the sifter. A further branch of the cold gas conduit communicates with a heat exchanger provided for preheating the combustion air supplied to the hot gas generator, while yet another branch of the cold gas conduit communicates with the hot gas generator.

The invention is thus based on the discovery that, the phenomenon of the volatile constituents being driven out of the fuel is not only dependent on temperature, but also depends on the grain size of the coal and the residence time of the grain in the hot atmosphere of the drying gas. Consequently, when the grain is in the drying gas for a given residence time, the admissible drying temperature must be reduced in proportion to reduced grain size of the coal, if the phenomenon of the volatile constituents being driven out is to be eliminated or at least substantially reduced. When using fan type mills for the grind-drying process, the residence time of the grain is predetermined in operation of the assembly, in the sense that it is based on the flow speed of the gas mixture in the drying section and the length of the drying section through which the material passes, approximately from the point at which the coal is introduced into the drying section to its point of entry into the separator disposed downstream of the mill. In other words, the residence time can be controlled by the position at which the coal is introduced, in dependence on the grain size, in order to achieve the desired effect. Accordingly, the fuel, for example crude brown coal, is added at a plurality of separate locations, on the basis of grain size fractions, more specifically in such a way that smaller grains of coal are introduced into the drying section which leads to the mill, at a point at which the temperature of the drying gas is at a lower level, the temperature of the gas is in the drying section falling at the moment that the first coal is added. A similar situation arises in regard to the degree of drying, or the moisture content, of the coal which is introduced, whereby drier coal is to be added at a point at which the drying gas is at lower temperature, than wet coal. However, as coarser grain fractions generally bind to themselves a greater amount of moisture than finer grain sizes, it is usually sufficient for the coal to be graded on the basis of its grain size, before being introduced into the drying gas, with the process therefore being controlled on the basis of the grading operation.

The mode of procedure in accordance with the invention permits the fuel to be satisfactorily ground-dried, without the caloric value of the resulting dust being substantially reduced due to the loss of volatile constituents. In addition, there are substantially no emissions which would result in environmental pollution or which could give rise to danger in some other fashion and it is relatively easy to maintain inert conditions. Moreover the increase in cost required when using the process according to the invention is negligibly low.

For the initial grading operation to separate out the finer component which is to be introduced into the drying section at a downstream position, it is generally sufficient to use a single sifter or separator disposed upstream of the fan mill. Such a sifter or separator substantially separates from the fuel the finely grained component in dust form which is entrained in the gas flow, with the fine component being introduced into the drying gas only in the downstream portion of the drying section; as it is already present in the form of dust the fine component does not need to be first passed through the mill.

However, according to the particular requirements involved, for example depending on the nature and the origin of the fuel and the inert grinding conditions to be observed, it will be appreciated that it may be necessary for a plurality of sifters or separators to be disposed upstream of the mill, to grade out the different grain fractions which in turn are introduced at different points in the drying section in the form of a gravity feed shaft or the like, in accordance with this invention.

Although the amount of fine dust which can be produced with the proposed kind of grinding installation is comparatively large, that is to say, in relation to other comparable dust grinding installations, nonetheless the construction of the fan type mills means that generally there is also present a certain amount of coarse ground material which obviously must be separated out. For that purpose, the installation according to the invention includes a second sifter or separator which is disposed downstream of the fan mill. The coarse material issuing from that sifter is passed through the mill once again, more particularly, being introduced in the drying section or gravity feed shaft directly upstream of the fan mill. The point at which the above-mentioned coarse material is introduced is substantially downstream of the point of introduction of the fuel which is already graded out in the first sifter and which has already caused a drop in the temperature of the drying gas.

In a section which is disposed downstream of the fan type mill and which is generally in the form of an upward shaft, the ground fuel again experiences intimate contact with the drying gas, whereby it attains the desired degree of drying, before passing into the second separator or sifter disposed downstream thereof. In addition, the dust or fine discharge product produced in the first upstream sifter also passes into the upward shaft and that fine product is dried to the same degree of drying, jointly with the fine coal leaving the mill, in the upward shaft.

Further objects, features and advantages of the invention will be apparent from the following drawings and accompanying description.

DETAILED DESCRIPTION OF THE PREFERRED EMBODIMENTS

Figure 1:
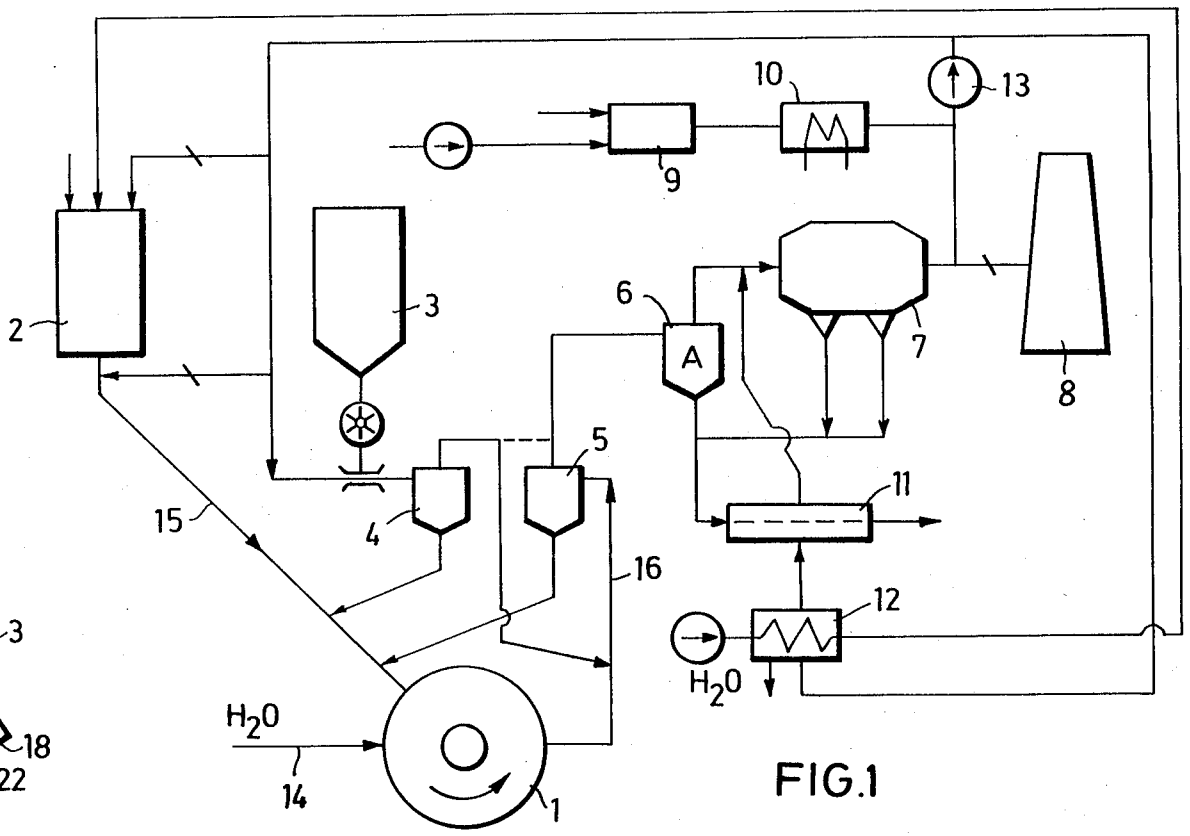
FIG. 1 is a diagrammatic view of an apparatus according to the invention.

Referring firstly to FIG. 1 for a description of the process and apparatus for grind-drying solid moist fuel such as for example brown coal, the apparatus illustrated comprises a fan type mill 1 of per se known kind and construction, as is used in modern coal-fired power generating stations. Disposed upstream of the mill 1 are a hot gas generator 2 for producing a hot drying gas with a low oxygen content, such as not more than 8% in the region of the mill 1, and a storage means for the fuel, such as a crude coal bunker 3. Disposed at the outlet of the bunker 3 is a first separator such as a sifter 4, the coarse discharge product of which passes into a drying section illustrated in the form of a gravity feed shaft 15 which connects the hot gas producer 2 to the intake of the mill 1. Disposed downstream of the mill 1 is an upward shaft 16 which communicates the mill with a second downstream separator such as a sifter 5. The coarse discharge product from the second downstream sifter 5 in turn passes into the gravity feed shaft 15, at a position which is closer to the mill 1 than the position at which the coal from the sifter 4 passes into the gravity feed shaft 15. The fine product from the sifter 4 is taken around the mill 1 to the upward shaft 16 at a position which is still sufficiently remote from the point at which the shaft 16 connects to the second sifter 5, to ensure that the fine material which is supplied from the sifter 4 has a sufficient residence time and thus drying effect, before passing into the sifter 5.

As indicated by the short broken line, the fine material discharged from the sifter 4 may also be fed to a dust trap or separator 6 directly, that is to say, bypassing the upward shaft 16 and the sifter 5. Whether that is possible essentially depends on the moisture content of the fine material issuing from the sifter 4.

The fine material issuing from the sifter 5 passes into the trap or separator 6 in which the ground dust is substantially separated from the drying gases. The dust which is drawn from the dust separator 6 is fed to a dust cooler 11 in which it is cooled down to storage temperature. The gases leaving the separator 6, which still contain residual dust, pass into a filter 7 of conventional kind, in which they are substantially cooled down so as to constitute a cold gas, while at the same time they are relieved of their residual dust charge. The residual dust removed is also fed to the dust cooler 11.

The cold gas which is drawn from the filter 7 is still at a temperature of from 100° C. to 150° C. and is conveyed back to the beginning of the process circuit by a cold gas blower or fan 13, so as to be distributed in the manner illustrated in FIG. 1 to various respective branch conduits upstream and downstream of the hot gas generator 2 and, by way of the outlet of the bunker 3, to the first sifter 4. The cold gas in question is a mixture, which is not combustible in itself, of combustion gases produced in the hot gas generator 2, small amounts of infiltrated air, the vapors ($H_2O$) which are produced when the brown coal is subjected to drying, nitrogen ($N_2$), carbon monoxide (CO), carbon dioxide ($CO_2$), traces of dust, and traces of volatile constituents which are produced in the grind-drying operation.

When the cold gas passes through the outlet of the bunker 3, it causes the fuel, for example crude brown coal, to be conveyed therewith into the sifter 4, where it produces the flow required for the sifting operation.

It will be seen from FIG. 1 that the circuit includes a branch conduit which branches off downstream of the discharge of the cold gas blower 13 and which carries a part of the cold gas into a heat exchanger forming an air preheater 12 through which the combustion air required in the hot gas producer 2 is passed. The flow component of cold gas which is branched off downstream of the blower 13 thus initially heats the combustion air. The cold gas which is further cooled down by virtue of that heat exchange action is then passed through the dust cooler 11 where it is heated again in order finally to be recycled to the dust filter 7 where it gives up again the charge of dust which it picked up in the dust cooler 11, in direct contact with the dust. The above-described circulation of the cold gas, within a substantially closed circuit, provides a particularly economical mode of operation, with frequent heat exchange and recovery. In this way, the process heat required is substantially retained.

However, at some locations in the circuit which is closed in itself, it is necessary to provide for intervention into the circuit from the outside. Thus for example, for the purposes of rendering the installation inert, when starting up and shutting down (it will be appreciated that, after starting up and shutting down the installation, it may take a certain period of time before the installation reaches its normal operating condition, or reaches a condition of full shut-down respectively), the installation has a combustion chamber or burner 9 for producing an inert gas which flows through a cooler 10 disposed downstream thereof, before being conveyed into the cold gas circuit by the cold gas blower 13. The output of the burner 9 is such that the losses due to heat radiation in the cold gas circuit can be compensated so that, when the installation is switched off, any condensation and residual moisture which may occur in the system can be expelled therefrom. Preferred fuels for the inert gas burner 9 are gas and oil because such fuels can be burnt with a very small excess of air. The excess of cold gas which occurs is discharged in the usual manner by way of a chimney 8.

The circuit also has at least one opening to the exterior, more specifically in the intake to the hot gas generator 2, at the point at which the fuel is supplied for producing the drying gas, and/or in the intake to the air preheater 12, where the combustion air required for the hot gas generator 2 is sucked in. Any condensate water which may be produced is desirably immediately removed at the air preheater as indicated by $H_2O$, before it passes into the drying gas circuit.

The addition of water becomes necessary if the grinding installation must be operated under part load conditions or with a small proportion of water in the fuel supplied. In that case, in order to maintain the inert atmosphere in the installation, water is sprayed by nozzle means into the mill 1 at a suitable location as indicated at 14. That injection of water simulates a higher degree of moisture in the coal, and the gas atmosphere within the system remains inert, due to the greater amount of drying gas which is therefore required, and due to the water vapor which is increased in amount as a result of the added water.

For the purposes of cooling the fine dust which is separated out in the separator 6 and the filter 7, the dust cooler 11 may be in the form of a cooling channel, wherein the dust which is at a temperature of about 100° C. is fluidized with substantially the portion of cold gas or recycled vapor which is tapped off downstream of the cold gas blower 13.

Figure 2:
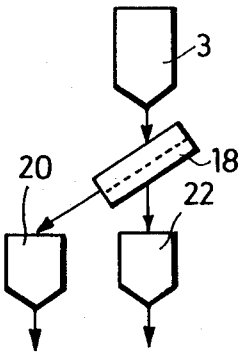
FIG. 2 shows a modification in part of the apparatus shown in FIG. 1.

As shown in FIG. 2, a modified form of the fuel or coal supply may comprise for example the provision of a sieving means 18 instead of the sifter 4 in which the solid fuel has to be transported pneumatically. A sieving means 18 of this kind is arranged for example underneath the bunker 3 and separates the coal into coarse and fine fractions as indicated at 20 and 22 respectively. The two fractions are fed to the flow of drying gas in the manner described hereinbefore.

Besides brown coal or lignite, other solid combustible materials such as, for example, glance or hard coal and peat, have also already been ground and dried using the above-described process and apparatus, with good results.

Various modifications and alterations may be made in the process and apparatus as described by way of example hereinbefore, without thereby departing from the scope of the appended claims.

What is claimed is:

1. A process for grind-drying wet solid fuel of different grain sizes into fine-grained particles, in a fan-type mill and in the presence of a stream of hot drying gas with a low oxygen content supplied to the mill, comprising the steps of:

separating off particles of the fuel which are already substantially of fine-grained size, grains of fuel in the remaining portion of the fuel requiring grinding;

selectively introducing grains of fuel in the remaining portion of the fuel into the stream of the drying gas upstream from the mill in dependence on the grain size of the fuel in such a way that the residence time of the fuel grains in the stream of drying gas decreases with decreasing grain size; and, grinding the remaining portion of the fuel in the mill, whereby loss of volatile constituents from the fuel during the grind-drying is substantially reduced.

2. A process according to claim 1, comprising the step of introducing coarser-grained and moister portions of the fuel into the stream of drying gas upstream from finer-grained and drier portions thereof.

3. A process according to claim 1, further comprising the step of separating out particles of fine-grained size from the fuel upstream and downstream of the mill.

4. A process according to claim 3, comprising the step of introducing the fuel which is separated upstream from the mill into the stream of drying gas upstream from the fuel which is separated downstream from the mill.

5. A process according to claim 1, comprising the step of controlling the oxygen content of the drying gas to be not more than 8%, at least in the region of the mill.

6. A process according to claim 1, comprising the step of processing brown coal.

7. A process according to claim 1, comprising the steps of:

directing the stream of drying gas through a drying means; and, selectively introducing the fuel into the drying means.

* * * * *